US006374525B1

(12) United States Patent
Thomas

(10) Patent No.: US 6,374,525 B1
(45) Date of Patent: Apr. 23, 2002

(54) FIREARM HAVING AN ELECTRICALLY SWITCHED IGNITION SYSTEM

(76) Inventor: Nils Thomas, 7940 Whistler Dr., Roanoke, VA (US) 24018

( * ) Notice: Subject to any disclaimer, the term of this patent is extended or adjusted under 35 U.S.C. 154(b) by 0 days.

(21) Appl. No.: 09/291,775

(22) Filed: Apr. 14, 1999

(51) Int. Cl.[7] ..... F41C 7/00

(52) U.S. Cl. ..... 42/51; 42/84

(58) Field of Search ..... 42/84, 51, 90, 42/74; 89/135, 20.05, 28.05; 431/357; 102/427, 288, 46, 202.2, 472

(56) References Cited

U.S. PATENT DOCUMENTS

| | | | | | |
|---|---|---|---|---|---|
| 3,580,113 | A | * | 5/1971 | Ramsay | 42/84 |
| 3,714,728 | A | * | 2/1973 | Perkins et al. | 42/84 |
| 3,726,222 | A | * | 4/1973 | White et al. | 102/46 |
| 3,748,770 | A | * | 7/1973 | Mitchell | 42/84 |
| 3,757,692 | A | | 9/1973 | Maue et al. | |
| 3,777,387 | A | * | 12/1973 | Ritchey | 42/84 |
| 3,859,746 | A | * | 1/1975 | Peckson | 42/84 |
| 4,332,098 | A | * | 6/1982 | Estenevy | |
| 4,384,423 | A | | 5/1983 | Ritchie | |
| 4,437,249 | A | * | 3/1984 | Brown et al. | 42/51 |
| 4,648,319 | A | | 3/1987 | Westerlund et al. | |
| 4,714,021 | A | | 12/1987 | Tranin | |
| 4,881,463 | A | * | 11/1989 | Ninio et al. | 102/202.2 |
| 5,115,743 | A | * | 5/1992 | Loffler | 102/472 |
| 5,227,577 | A | * | 7/1993 | Eich et al. | 89/28.05 |
| 5,241,909 | A | | 9/1993 | Eches et al. | |
| 5,485,786 | A | * | 1/1996 | Hesse et al. | 102/202.5 |
| 5,561,934 | A | | 10/1996 | Knight | |
| 5,608,982 | A | * | 3/1997 | Bouvard et al. | 42/84 |
| 5,625,972 | A | * | 5/1997 | King et al. | 42/84 |
| 5,644,861 | A | | 7/1997 | Knight | |
| 5,651,203 | A | | 7/1997 | Knight | |
| 5,722,193 | A | | 3/1998 | Post | |
| 5,726,378 | A | * | 3/1998 | Barrett | 102/288 |
| 6,085,454 | A | * | 7/2000 | Caudie | 42/90 |

* cited by examiner

*Primary Examiner*—Charles T. Jordan
*Assistant Examiner*—Troy Chambers
(74) *Attorney, Agent, or Firm*—Arthur L. Plevy; Duane Morris

(57) ABSTRACT

A firearm including a barrel having a combustion chamber for receiving propellant and at least one projectile, includes an electrically switched propellant igniting element disposed within the chamber for igniting propellant dispensed into the combustion chamber. A trigger switching assembly, electrically coupled to the igniting element, applies an electrical current pulse to the igniting element when the trigger assembly is operated in a firing mode, the pulse having a duration which causes the igniting element to ignite propellant dispensed into the combustion chamber.

20 Claims, 2 Drawing Sheets

FIREARM HAVING AN ELECTRICALLY SWITCHED IGNITION SYSTEM

FIELD OF THE INVENTION

This invention relates to firearms, and in particular, to a firearm having a closed breech electrically switched ignition system.

BACKGROUND OF THE INVENTION

Firearms which are loaded through their barrels with quick-burning, powder-type propellants are commonly referred to as muzzleloaders. Muzzleloaders are typically used by hunters during special "muzzleloading" hunting seasons where use of modern center-fire firearms or like rifles is prohibited. Commonly known designs include match-lock, wheel-lock, flint-lock, and percussion muzzleloaders, which are distinguished by their ignition mechanisms.

As shown in FIG. 4, a conventional muzzleloader typically includes a barrel 60, the breech of which defines a combustion chamber 62, a breech plug 64 enclosing the breech of the barrel 60, a vent 66 disposed in the wall of the barrel 60 (or breech plug), an ignition system constructed with a percussion nipple 68 (or a flint and striker mechanism), and a hammer and trigger arrangement 74. The muzzleloader is operated by pouring a finite amount of powdered propellant 71 down the forward end of the barrel 60. A projectile, such as a slug or ball, is then inserted into the barrel 60 and pushed down onto the propellant 71. The muzzleloader must then be primed. Muzzleloaders with percussion nipple ignition systems as shown in FIG. 4, are primed by placing a percussion cap 70 on the percussion nipple 68. Muzzleloaders with flint and striker mechanisms are primed by placing propellant in a pan structure of the flint and striker mechanism. After priming, the muzzleloader is fired by cocking the hammer and then pulling the trigger. In percussion nipple ignition systems, the hammer 75 strikes the percussion cap 70 which contains a small amount of propellant 73 that ignites on impact, producing a hot flame of gas. This hot flame of gas travels through the nipple 68 and vent 66 to ignite the propellant 71 in the combustion chamber 62. In flint and striker ignition systems, the hammer contains flint which strikes a steel bar, thus creating a spark which ignites the propellant in the pan. The propellant in the pan bums rapidly, creating a flame and gas which travel through the vent and ignite the propellant in the combustion chamber. Upon ignition with either system, the propellant 71 in the breech burns quickly, building high pressures which accelerate the projectile 72 rapidly down the barrel 60 toward a target.

Unfortunately, conventional ignition systems used on muzzleloaders lessen their accuracy, are not always reliable, are slow to reload, and produce less firepower than center-fire rifles. The reduced accuracy results from undesirably long "lock-times". Lock-time is a time period which is measured from when the trigger is pulled until the projectile exits the barrel. Long lock times reduce shooting accuracy because the firearm has more time to vibrate and drift off the target after the trigger is pulled. The lock-times of conventional muzzleloader ignition systems are excessive because it takes a relatively long period of time for the flame and gas to travel through the vent to ignite the propellant. Typical muzzleloaders have lock-times that range from about 20 milliseconds to about 50 milliseconds. For comparison, a modern center-fire rifle has a lock-time of approximately 15 milliseconds.

Accuracy is also reduced by the vent which permits the gases generated by the propellant charge in the breech to escape therefrom into the air. The venting of gases lowers breech pressure which in turn, reduces projectile velocity. The reduced projectile velocity lessen the muzzleloader's accuracy because wind drift has more time to alter the trajectory of the projectile before it reaches the target.

Conventional ignition systems used on muzzleloaders are also slow to reload because each shot requires recharging of the priming system either with propellant or a cap. Reprimming takes time and manual dexterity and caps can be lost or propellant spilled when priming under stressful conditions, thus delaying the time to fire.

A further disadvantage of these ignition systems is that the cap or propellant is susceptible to contamination from water, particularly rain or human contact, resulting in unreliable ignition. Many misfires are caused by caps or propellant which have been contaminated with water from rainy conditions. The vent also allows moisture to seep through its mechanical joints into the propellant in the combustion chamber which can result in poor ignition even if the cap operates properly.

The vent causes other ignition problems as well. In particular, the vent hole is susceptible to particle contamination from the cap, hunter, or propellant itself due to small diameter of the vent's orifice which limits the gases escaping from vent. If the vent orifice becomes plugged, the gases from the cap will not hit the propellant, and the muzzleloader will not fire.

Accordingly, there a need for muzzleloaders with improved ignition systems which provide increased accuracy, ignition reliability, faster reloading, and increased firepower.

SUMMARY OF THE INVENTION

A firearm comprises a barrel having a combustion chamber for receiving propellant and at least one projectile. Electrically switched propellant igniting means are provided within the chamber for igniting propellant dispensed into the combustion chamber. Trigger switching means, electrically coupled to the igniting means, apply an electrical current pulse to the igniting means when the trigger means is operated in a firing mode, the pulse having a duration which causes the igniting means to ignite propellant dispensed into the combustion chamber.

BRIEF DESCRIPTION OF THE DRAWINGS

The advantages, nature and various additional features of the invention will appear more fully upon consideration of the illustrative embodiments now to be described in detail in connection with the accompanying drawings wherein.

It is to be understood that these drawings are for purposes of illustrating the concepts of the invention and are not to scale.

DETAILED DESCRIPTION OF THE INVENTION

Figure 1:
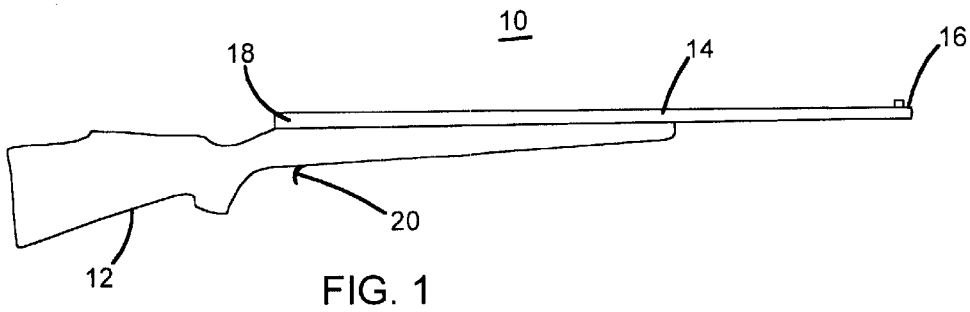
FIG. 1 is a side elevational view of a muzzleloading firearm employing the ignition system of the invention.

FIG. 1 shows an embodiment of a muzzleloading firearm 10 which employs the ignition system of the invention. The firearm 10 includes a gun stock 12 and a barrel 14 mounted on the gun stock 12. The barrel 14 includes a forward end 16 and a rearward end 18. A trigger member 20 is provided for firing the firearm 10.

Figure 2:
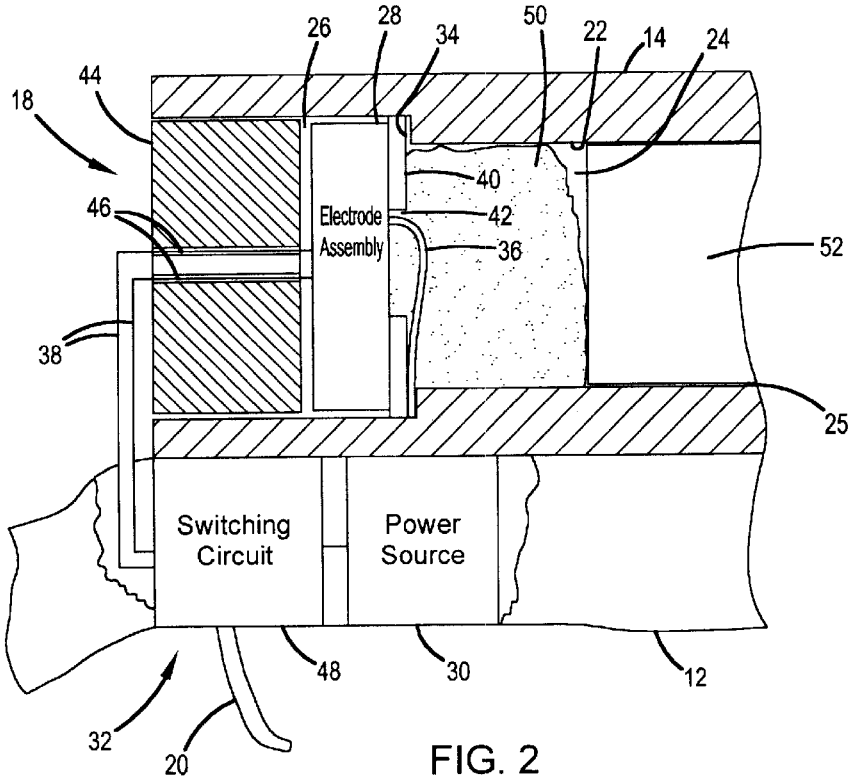
FIG. 2 is a sectional view through the rearward end of the barrel of the firearm shown in FIG. 1.

As shown in FIG. 2, the rearward end 18 or breech of the barrel 14 has a stepped axial bore 22 that defines a first chamber portion 24 which merges with or is part of the main bore 25 of the barrel 14, and a larger diameter second chamber portion 26. The first chamber portion 24 forms a combustion chamber for receiving propellant 50 and one or more projectiles 52 (one shown) dispensed through the forward end 16 of the barrel 14. The propellant 50 is ignited by an electrically switched ignition system comprised of an electrode assembly 28, a power source 30 for powering the electrode assembly 28 and an electrical trigger switching assembly 32 for electrically coupling and uncoupling the electrode assembly 28 to the power source 30 when the trigger assembly 32 of the firearm 10 is operated as will be explained further on in greater detail. The electrode assembly 28 is disposed in the second chamber portion 26, against the step 34 in the axial bore 22. The electrode assembly 28 includes a propellant igniting element 36 typically in the form of a resistive heating filament which projects into the first chamber portion 24, and electrical wires 38 that electrically couple the electrode assembly 28 to the trigger switching assembly 32. A circular-shaped insulator 40 having a centrally located opening 42 which permits the filament 36 to extend into the first chamber portion 24, is disposed between the electrode assembly 28 and the step 34, for insulating the electrode assembly 28 from the first chamber 24. The terminal end of the igniting element 36 is grounded to the barrel 14 by securely wedging it between a portion of the insulator 40 and the step 34. A breech plug 44 encloses the rearward end 18 of the barrel 14. The breech plug 44 includes apertures 46, which permit the electrical wires 38 electrically coupling the electrode assembly 28 with the trigger switching assembly 32, to extend through the plug 44.

The trigger switching assembly 32 is typically disposed where a conventional trigger assembly would be located. The power source 30 is typically adjacent to the trigger switching assembly 32 or incorporated therein. The trigger switching assembly 32 typically includes the trigger member 20 and a timed switching circuit 48 operated by the trigger member 20. The trigger switching assembly 32 can be implemented using any conventional finger actuated electrical switching device that is capable of applying an electrical current pulse, supplied by the power source 30, to the electrode assembly 28 when the trigger member 20 is operated to fire the muzzleloader 10, the pulse having a time duration which causes the igniting element 36 to produce heat and ignite propellant 50 dispensed into the first chamber 24. Suitable trigger switching assemblies can include conventional electromechanical switches, pressure sensitive switches, heat sensitive switches and the like.

The power source 30 typically comprises conventional rechargeable or non-rechargeable batteries which are capable of supplying a current pulse of a suitable amperage and duration for causing the igniting element 36 to produce a quantity of heat which is sufficient to ignite propellant 50 dispensed in the first chamber 24.

The filament 36 of the electrode assembly 28 ignites propellant 50 through resistive heating of the filament 36 to the ignition temperature of the propellant 50. The electrical current pulse applied to electrode assembly 28 causes the filament 36 to become heated. This is accomplished by matching the filament's 36 resistance to its mass so that the filament 36 becomes heated when the current pulse flows through it. The duration of the current pulse is selected to permit the filament 36 to become sufficiently heated to ignite the propellant 50 while preventing the filament 26 from burning up due to excessive heating.

The ignition system of the invention advantageously provides more reliable ignition of the propellant 50 because the filament 36 extends into the combustion chamber 24, thus contacting propellant 50 contained therein. Further, because the barrel 14 can now be constructed without a vent, the propellant 50 and the filament 36 are not as susceptible to contamination from water or a user. However, because water vapor can still be absorbed by the propellant 50 through the projectile and barrel interface, the trigger switching assembly 32 in other embodiments of the ignition system can also be capable of supplying the electrode assembly 28 with a continuous series of current pulses (supplied by the power source 30) when in a non-operative standby mode. The continuous series of current pulses should have a frequency and duration that are sufficient for heating the filament 36 to a temperature substantially lower than the ignition temperature of the propellant 50 but substantially high enough to drive off any absorbed water. For example, typical commercially available smoke-emitting and smokeless or "Black powder substitute" propellants, which are anticipated for use in muzzle-loading firearms employing the ignition system of the invention, have ignition temperatures of approximately 400° C. One such propellant known as PYRODEX is marketed by Hodgdon Powder Co. Water vapor can be driven from PYRODEX propellant by maintaining a temperature within the combustion chamber 24 of about 35° C. via pulsing of the electrode assembly 28. Trigger switching assemblies which are also capable of applying a continuous series of current pulses can be implemented with conventional finger-actuated electrical switching devices including but not limited to electromechanical switches, pressure sensitive switches, and heat sensitive switches.

Locating the igniting element or filament 36 in the propellant 50 and using an electrical pulse to fire it also improves the accuracy of the firearm 10 because the time period from trigger operation is greatly reduced because the trigger switching assembly 32 operates in substantially less time than a conventional hammer or striker-type ignitor, and in substantially less time than a trigger pull. Moreover, the igniting element or filament 36 can reach the propellant ignition temperature in substantially less time than the gases from a conventional percussion cap or flint-lock can travel to reach the propellant.

The ignition system of the invention also substantially improves the fire-power of the firearm 10. This is because the vent present in conventional ignition systems, which permits burning propellant gases to escape from the breech, thus reducing projectile velocity, is eliminated in the ignition system of the invention. The ignition system of the invention, therefore provides increased projectile velocities which advantageously result in improved firepower.

As mentioned earlier, it is anticipated that muzzle-loading firearms employing the ignition system of the invention will be capable of using modem smokeless propellants which offer many advantages over smoke-emitting propellants that muzzle-loading firearms with conventional ignition system must use because of safety issues. In particular, muzzle-loading firearms with conventional open vent ignition systems can be deadly to the user if smokeless propellants are used because these propellants produce higher gas pressures which can cause the other components of conventional ignition systems such as the percussion nipple or the flint and striker mechanism to explode. No such components are used in the ignition system of the invention, therefore, limitations associated with these components are not an issue.

Accordingly, muzzle-loading firearms with the ignition system of the invention achieve other advantages when smokeless propellants are used. Smokeless propellants are environmentally more friendly than smoke-emitting propellants because they are cleaner, thus, making muzzle-loading firearms with the inventive ignition system environmentally friendlier than muzzle-loading firearms with conventional ignitions. Further, smokeless propellants impart much greater velocities to the projectiles than conventional smoke-emitting propellants. Hence, even greater fire-power can be achieved in a muzzle-loading firearm having the ignition system of the invention.

Figure 3:
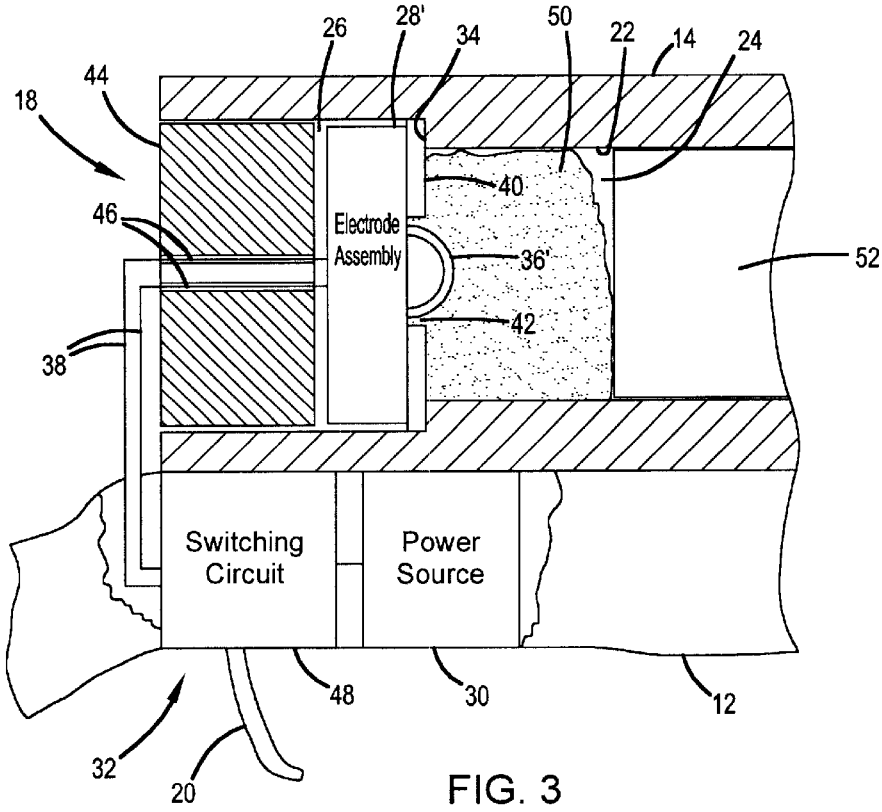
FIG. 3 is a sectional view showing an electrode assembly according to a second embodiment of the invention.
Figure 4:
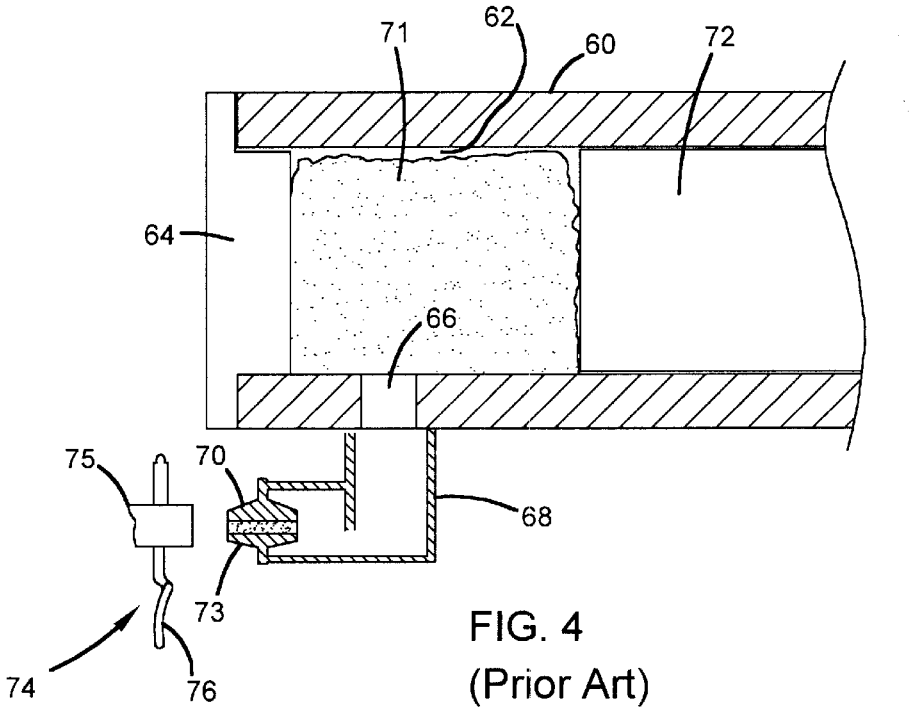
FIG. 4 (Prior Art)
FIG. 4 is a sectional view showing a prior art ignition system.

FIG. 3 shows a muzzleloading firearm 10 which employs a second embodiment of the ignition system of the invention. In the second embodiment, the electrode assembly 28' includes an igniting element 36' which is internally grounded in the electrode assembly 28'.

While the foregoing invention has been described with reference to the above embodiments, various modifications and changes may be made without departing from the spirit of the present invention. For example, the exact structural shape of the igniting element shown in the drawings can be altered to maximize the performance of the ignition system, the structural shape being dependent upon whether the propellant used is in powder form, pellet form or some other physical form. These and other modifications and changes are considered to be within the scope of the claims.

What is claimed is:

1. A muzzleloader comprising:

a barrel having a combustion chamber for receiving propellant and at least one projectile;

electrically switched propellant igniting means disposed within the chamber for igniting propellant dispensed into the combustion chamber; and trigger switching means electrically coupled to the igniting means for applying an electrical current pulse to the igniting means when the trigger means is operated in a firing mode, the pulse having a duration which causes the igniting means to ignite propellant dispensed into the combustion chamber.

2. The muzzleloader according to claim 1, wherein the combustion chamber is unvented.

3. The muzzleloader according to claim 1, wherein the igniting means produces a quantity of heat in response to the current pulse, which ignites propellant dispensed in the combustion chamber.

4. The muzzleloader according to claim 1, wherein the igniting means comprise a resistive heating filament which produces a quantity of heat in response to the current pulse, which ignites propellant dispensed in the combustion chamber.

5. The muzzleloader according to claim 1, wherein the trigger switching means is further operative in a standby mode for applying a continuous series of electrical current pulses to the igniting means, the pulses having a frequency and duration which cause the igniting means to vaporize water absorbed in propellant dispensed into the combustion chamber without igniting the propellant.

6. The firearm according to claim 5, wherein the igniting means produces a quantity of heat in response to the continuous series of current pulses, which vaporizes water absorbed in propellant dispensed in the combustion chamber.

7. The firearm according to claim 5, wherein the igniting means comprise a resistive heating filament which produces a quantity of heat in response to the continuous series of current pulses, which vaporizes water absorbed in propellant dispensed in the combustion chamber.

8. The muzzleloader according to claim 1, wherein the igniting means directly contacts propellant dispensed in the combustion chamber.

9. The muzzleloader according to claim 1, wherein the propellant is selected from the group consisting of smokeless, smoke-emitting and black powder substitute propellants.

10. The muzzleloader according to claim 1, wherein the propellant includes one of powdered and pelletized propellants.

11. An electrically switched ignition system for a firearm which comprises a muzzleloader, the system comprising:

electrically switched propellant igniting means to be positioned within a combustion chamber of a firearm for igniting propellant dispensed into the combustion chamber; and trigger switching means electrically coupled to the igniting means for applying an electrical currant pulse to the igniting means when the trigger switching means is operated in a firing mode, the pose having a duration which causes the igniting means to ignite propellant dispensed into the combustion chamber.

12. The ignition system according to claim 11, wherein the igniting means produces a quantity of heat in response to the current pulse, which ignites propellant dispensed in the combustion chamber.

13. The ignition system according to claim 11, wherein the igniting means comprise a resistive heating filament which produces a quantity of heat in response to the current pulse, which ignites propellant dispensed in the combustion chamber.

14. The ignition system according to claim 11, wherein the trigger switching means is further operative in a standby mode for applying a continuous series of electrical current pulses to the igniting means, the pulses having a frequency and duration which cause the igniting means to vaporize water absorbed in propellant dispensed into the combustion chamber without igniting the propellant.

15. The ignition system according to claim 14, wherein the igniting means produces a quantity of heat in response to the continuous series of current pulses, which vaporizes water absorbed in propellant dispensed in the combustion chamber.

16. The ignition system according to claim 14, wherein the igniting means comprise a resistive heating filament which produces a quantity of heat in response to the continuous series of current pulses, which vaporizes water absorbed in propellant dispensed in the combustion chamber.

17. The ignition system according to claim 11, wherein the igniting means directly contacts propellant dispensed in the combustion chamber.

18. The ignition system according to claim 11, wherein the propellant is selected from the group consisting of smokeless, smoke-emitting and black powder substitute propellants.

19. The ignition system according to claim 11, wherein the propellant includes one of powdered and pelletized propellants.

20. The ignition system according to claim 11, wherein the combustion chamber of the firearm is unvented.

* * * * *

UNITED STATES PATENT AND TRADEMARK OFFICE

CERTIFICATE OF CORRECTION

PATENT NO. : 6,374,525 B1
DATED : June 20, 2002
INVENTOR(S) : Nils Thomas

It is certified that error appears in the above-identified patent and that said Letters Patent is hereby corrected as shown below:

Column 6,
Lines 15 and 16, delete the phrase “a firearm which comprises”;
Line 22, delete the word “currant” and insert therefor -- current --; and
Line 24, delete the word “pose” and insert therefor -- pulse --.

Signed and Sealed this

First Day of October, 2002

*Attest:*

*Attesting Officer*

JAMES E. ROGAN
*Director of the United States Patent and Trademark Office*